US007303103B2

(12) United States Patent
Wang

(10) Patent No.: US 7,303,103 B2
(45) Date of Patent: Dec. 4, 2007

(54) STRUCTURE OF ARRESTING MECHANISM FOR NAIL GUNS

(75) Inventor: Guan-Ho Wang, Tali (TW)

(73) Assignee: Nailermate Enterprise Corp., Tali, Taichung Hsien (TW)

( * ) Notice: Subject to any disclaimer, the term of this patent is extended or adjusted under 35 U.S.C. 154(b) by 0 days.

(21) Appl. No.: 11/293,325

(22) Filed: Dec. 2, 2005

(65) Prior Publication Data

US 2007/0125821 A1 Jun. 7, 2007

(51) Int. Cl.
*B25C 1/04* (2006.01)

(52) U.S. Cl. ..... 227/8; 227/130

(58) Field of Classification Search ..... 227/130, 227/8, 120, 156

See application file for complete search history.

(56) References Cited

U.S. PATENT DOCUMENTS 5,219,110 A * 6/1993 Mukoyama ..... 227/8
5,551,621 A * 9/1996 Vallee ..... 227/8
5,593,079 A * 1/1997 Mukoyama et al. ..... 227/8
5,715,982 A * 2/1998 Adachi ..... 227/8
6,012,622 A * 1/2000 Weinger et al. ..... 227/8
6,908,021 B1 * 6/2005 Wang ..... 227/8
6,913,179 B1 * 7/2005 Chen ..... 227/8
6,929,165 B1 * 8/2005 Chen et al. ..... 227/8
6,953,137 B2 * 10/2005 Nakano et al. ..... 227/8
6,966,477 B1 * 11/2005 Chien-Kuo et al. ..... 227/8
6,997,365 B2 * 2/2006 Miller et al. ..... 227/8
7,097,084 B2 * 8/2006 Ho ..... 227/8

* cited by examiner

*Primary Examiner*—Scott A. Smith
(74) *Attorney, Agent, or Firm*—Charles E. Baxley

(57) ABSTRACT

An arresting mechanism to prevent a nail gun from cocking and firing when there are no nails in its magazine. A trigger includes a retaining part organized to prevent the trigger from cocking to fire. A cotter is arranged for sliding engagement in the trigger mechanism. The cotter is provided along an axial length with a convex portion. A swingable sensing component is pivotally mounted outwardly of the housing with a magazine end projecting into the magazine and pushed outwardly by nails therein. Consequently the other end of the sensing component is pushed on to and holds the cotter during normal operation so that it does not activate the retaining part. When no nail is in the magazine the magazine end of the sensing component is no longer pushed outwardly so the cotter is moved by a spring to position its convex portion to activate the retaining part so as to jam the trigger whereby it can not cock and shoot.

10 Claims, 4 Drawing Sheets

STRUCTURE OF ARRESTING MECHANISM FOR NAIL GUNS

FIELD OF THE INVENTION

The present invention relates to a nail gun, and more particularly to an arresting mechanism for nail guns for preventing a user from shooting the nail gun without nails.

BACKGROUND OF THE INVENTION

Generally speaking, a prior-art nail gun is composed of a magazine and a nailing mechanism. The magazine accommodates nails and the nailing mechanism includes a trigger for the user to cock and shoot the nails. When there are nails loaded in a magazine of the nail gun, the nailing device typically shoots at least one nail every time the user cocks the trigger. However, when the magazine is empty, the user can still cock the trigger and the nailing device reacts to the user's cocking as usual but there is no nail to be shot. Moreover, the user may usually cock several more times to make sure that there is no nail in the magazine and such dry firing can substantially harm and even be self-destructive of the nailing device. Thusly, lives of the nail guns are shortened when such ineffective shooting occurs frequently.

SUMMARY OF THE INVENTION

A primary objective of the present invention is to provide a solution to the problem that the trigger of a prior-art nail gun can be cocked without nails, which causes the nailing device to act and even self destructively. The purpose and effect of the present invention is to provide a mechanism that jams and restrains the trigger mechanism from being cocked and fired when there is no nail in the magazine.

Technical measures taken by the invention to achieve the foregoing purpose and effect are given below.

An arresting mechanism is applied to a nail gun that is composed of a magazine and nailing mechanism. The nail gun comprises a trigger which is operatively connected between two pin plates of the nailing mechanism and during ordinary operation can be cocked to shoot nails. The arresting mechanism contains a cotter, which penetrates the two pin plates and has a head that appears on one of the pin plates; at least one salient, preferably conves portion with at least one consequent concave portion disposed axially along said cotter, wherein the shaft diameter of the concave portion typically is smaller than the shaft diameter of the convex portion; a resilient means shown as a spring, with its one end abutting said pin plate, which surrounds the cotter and its resilient force acts thereupon; at least one retaining part is disposed on the trigger that allows the convex portion of the cotter to be arrested and retained thereon; a swinging sensing component, which is mounted on the magazine, with its first end settled corresponding to the magazine and further extending into the magazine to contact the nails while its second end acts as a lever arm coming into contact with a first end or head of said cotter.

BRIEF DESCRIPTION OF THE DRAWINGS

The invention as well as a preferred modes of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

To make it easier for our examiner to understand the objective of the invention, its structure, innovative features and performance, we use a preferred embodiment together with the attached drawings for the detailed description of the invention.

Figure 1:
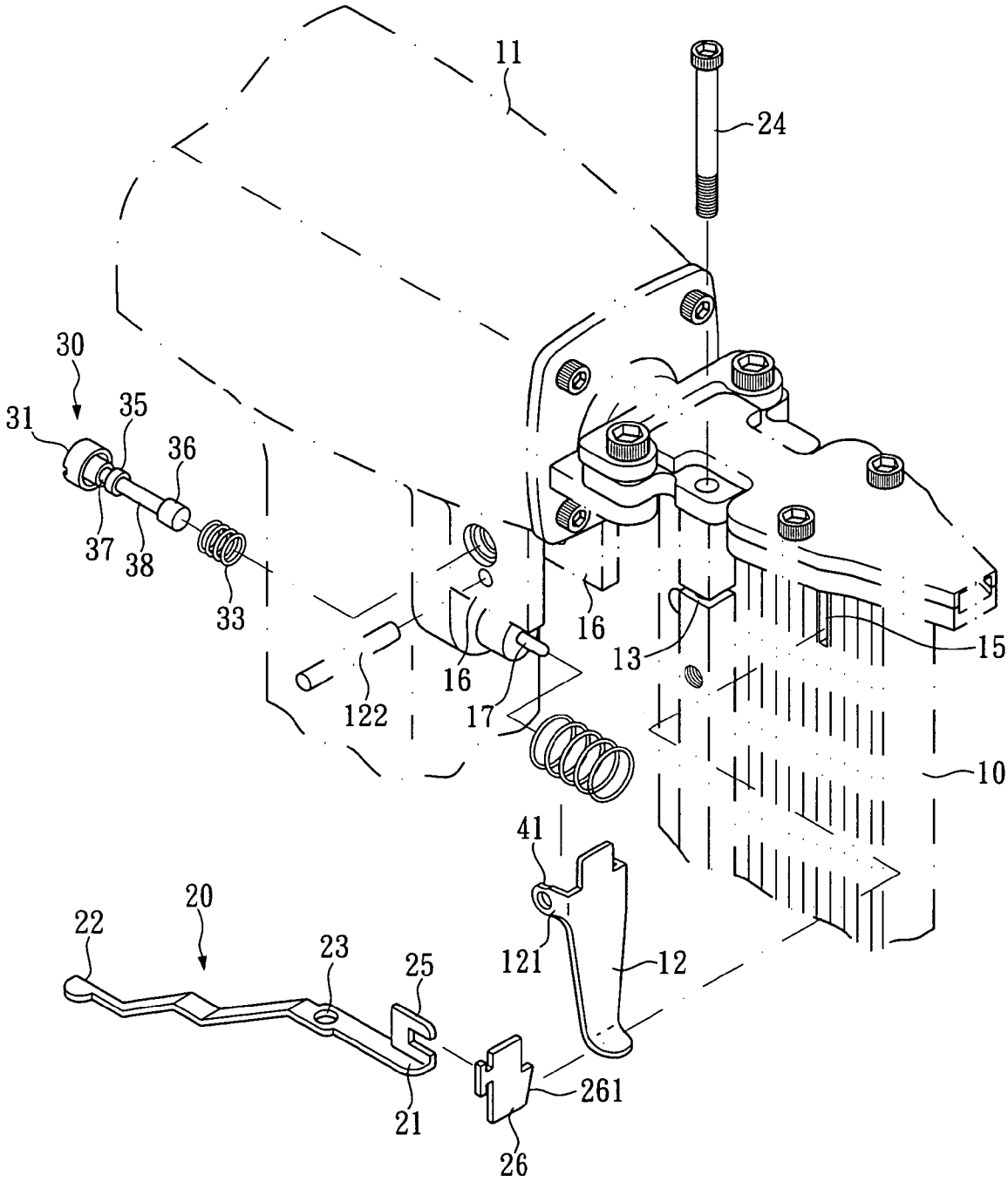
FIG. 1 is an exploded view of the arresting mechanism of the present invention.
Figure 2:
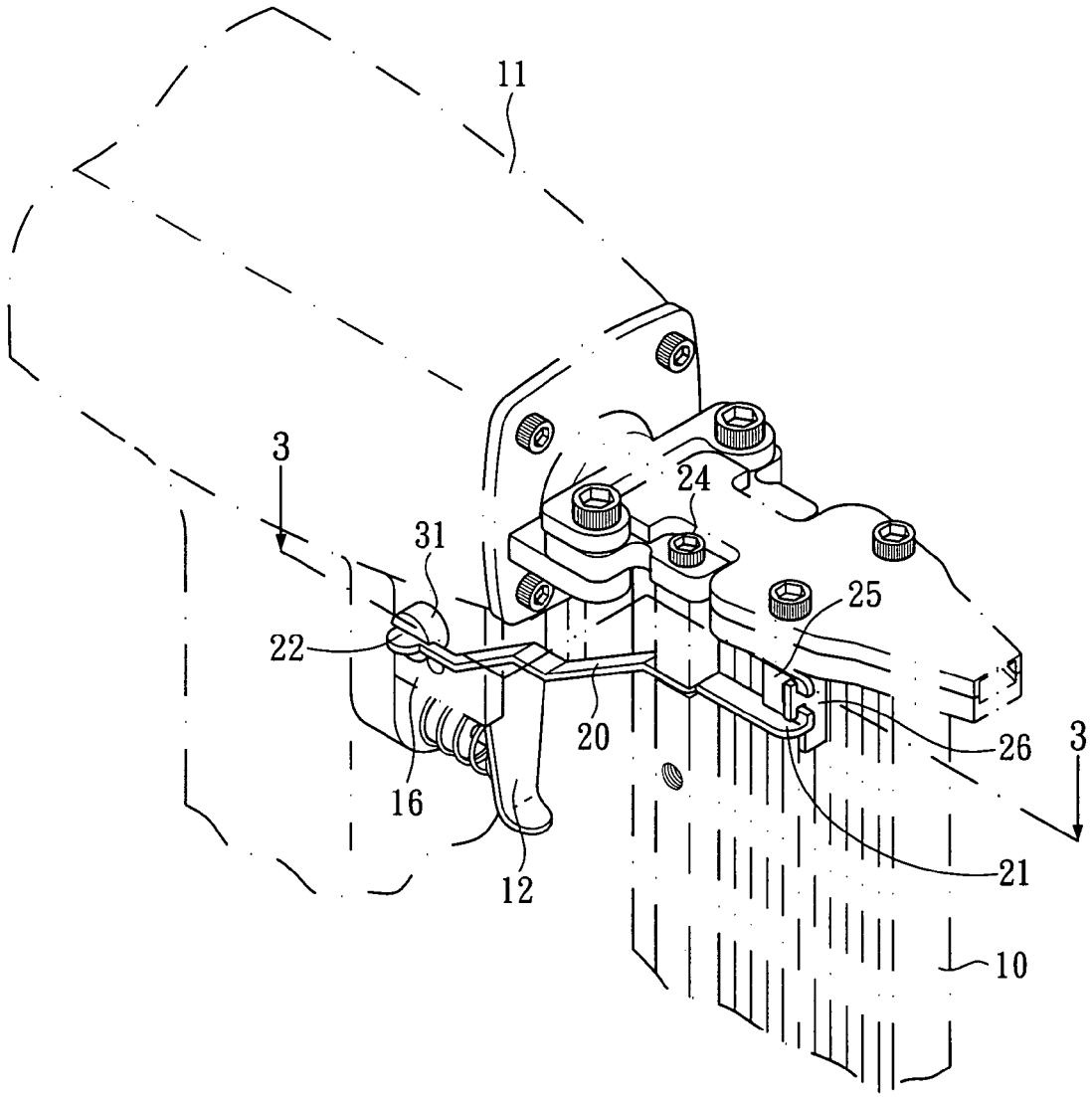
FIG. 2 is a view showing the arresting mechanism of the present invention applied to a nail gun.
Figure 3:
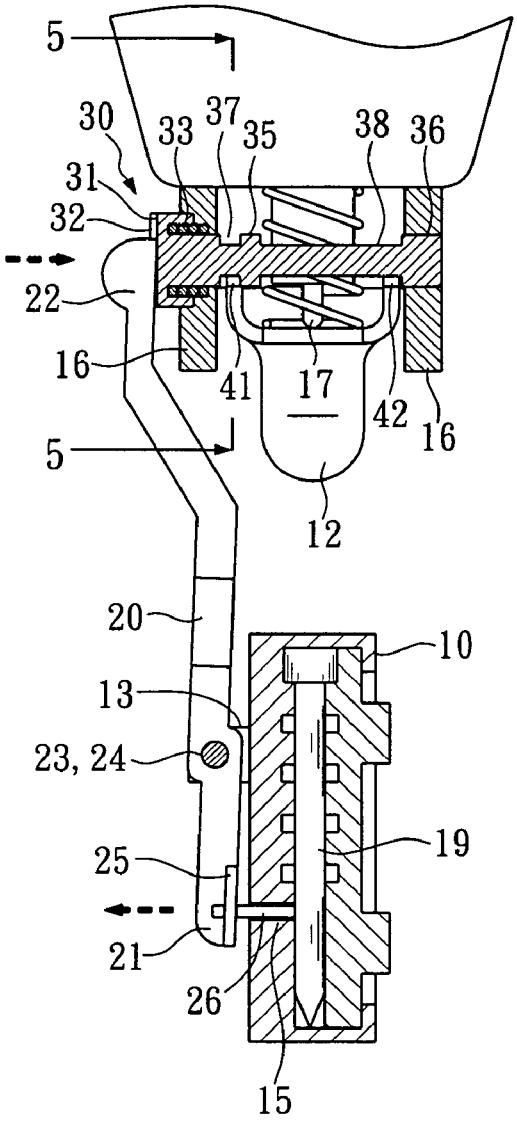
FIG. 3 is a sectional view taken along line 3-3 of FIG. 2 and showing nails in the magazine.

Please refer to FIGS. 1, 2 and 3 for a nail gun according to the invention, which comprises a magazine 10 and a nailing mechanism 11. The magazine 10 accommodates nails and the nailing mechanism 11 which comprises a trigger 12 for a user to cock and shoot the nails. The trigger 12 compresses an actuator 17 when being cocked. Generally, the actuator 17 causes the nailing mechanism 11 to shoot at lease one nail each time the user cocks the trigger. The invention provides an arresting mechanism to prevent against shooting without nails for any type of nail gun. The mechanism comprises a sensing component 20 which can be arranged substantially outside of the magazine 10. A magazine end 21 of the sensing component extends into the magazine to contact the nails and a lever arm end 22 of the sensing component extend alongside oppositely to the trigger 12. There is also a medial portion of the sensing component between the magazine end 21 and the lever arm and 22. As shown in the figures, a space 13 is disposed outside the magazine 10 for accommodating the sensing component 20. The sensing component 20 further defines an axial hole 23 which is disposed corresponding to the space 13. A pin 24 positions the sensing component 20 by penetrating through the space 13 and the axial hole 23 and allows the sensing component 20 to pivot sidewise about on the pin 24 like a turnstyle. A fastening device 25 is disposed at the magazine end 21 of the sensing component 20 to so as to co-act with a tenon 26 which extends into the magazine 10 via a through hole 15. The tenon 26 includes a an inclined plane 261 which functions inside the magazine 10. When passing by the inclined plane 261, the nails push the tenon 26 outwardly of the magazine 10. Therefore, the magazine end 21 of the sensing component 20 pivots rotationally about the pin 24 correspondingly to the tennon and the lever arm end 22 of the sensing component 20 pivot reversely about the pin 24 to press the lever arm 22 onto a head 31 of a cotter 30. So at least one nail in the magazine provides a push of the lever arm 22 to press on the head 31 of the cotter 30 at the nailing mechanism 11.

The cotter 30 penetrates both of the pin plates 16 of the nailing mechanism 11, and has the first end or head 31 which is on the pin plate 16. A socket 32 is arranged on the head 31 to contain the lever arm end 22 of the sensing component 20. A spring 33 is disposed between the head 31 and the pin plate 16 to interact with the cotter 30, in the manner that the cotter 30 compresses the spring 33 when being pushed by the lever arm end 22 of the sensing component 20 and when the pressing force, ceases, the spring 33 pushes the cotter 30 away from the pin plate 16. The cotter 30 located between the pin plates 16 further comprises an axial length with at least one salient portion of its length having a different, preferably convex portion 35 and at least one remaining concave portion adjacent thereto 37 which are arranged adjacent with other coaxially along an axial length of the cotter 30. Further shaft diameter of the concave portion 37 is smaller than that of the convex portion 35.

Please refer to the figures again; according to the present invention, the first 35 and a second 36 convex portions are disposed on the cotter 30. The first concave portion 37 is disposed between the first convex portion 35 and the head 31 and a second concave portion 38 is disposed between the second convex portion 36 and the first convex portion 35.

There is at least one pair of retaining parts 41, 42 on said trigger 12 to allow the first and second convex portions 35,36 of the cotter 30 to be pressed thereon so that the trigger 12 is wedged and can not be cocked by the user. As shown in the figures, there are wing sections 121 arranged at each side of said trigger 12 to allow a pint 122 through for fastening the trigger 12 between the two pin plates 16. The foregoing retaining parts 41, 42 are respectively disposed on the top surfaces of the wing sections 121 and are presented in the form of sockets.

Accompanied with the description of the foregoing structure, the principle of the movements for this invention is elaborated as follows.

Figure 5:
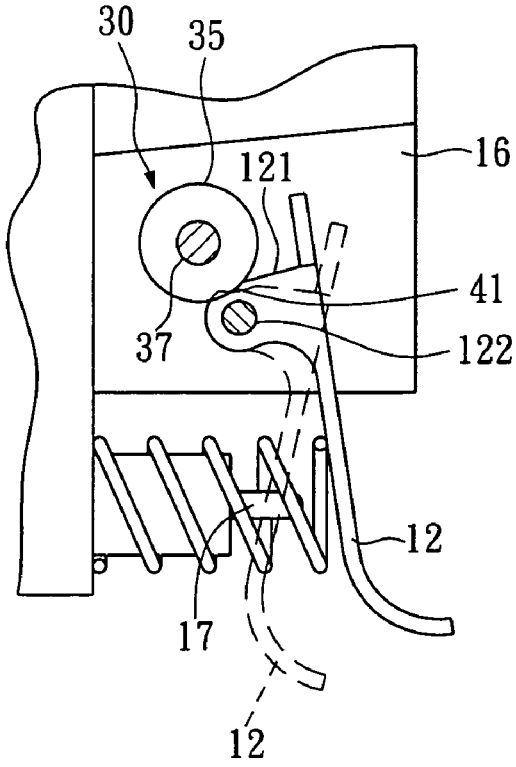
FIG. 5 is a sectional view taken along line 5-5 of FIG. 3.

Please refer to FIGS. 3 and 5 for the invention. If there are some nails 19 loaded in the magazine 10, pushing on the inclined plane 261 the nails shore up the tenon 26 outward the magazine 10, and accordingly, the magazine end 21 of a sensing means shown as the sensing component 20 is pushed correspondingly outwardly whereby the lever arm end 22 of the sensing component 20 pushes inwardly to push onto and restrain the first end or head 31 of the cotter 30 in its firing mode. When the cotter 30 sequentially compresses the spring 33, the first and second concave sections 37, 38 are located correspondingly to the retaining parts 41, 42 of the trigger 12. Because the first and the second concave portions 37, 38 are diametrically too smaller to reach the retaining parts 41, 42, the trigger 12 can be cocked (as the dotted line shown in FIG. 5) and the nail gun is allowed to shoot.

Figure 4:
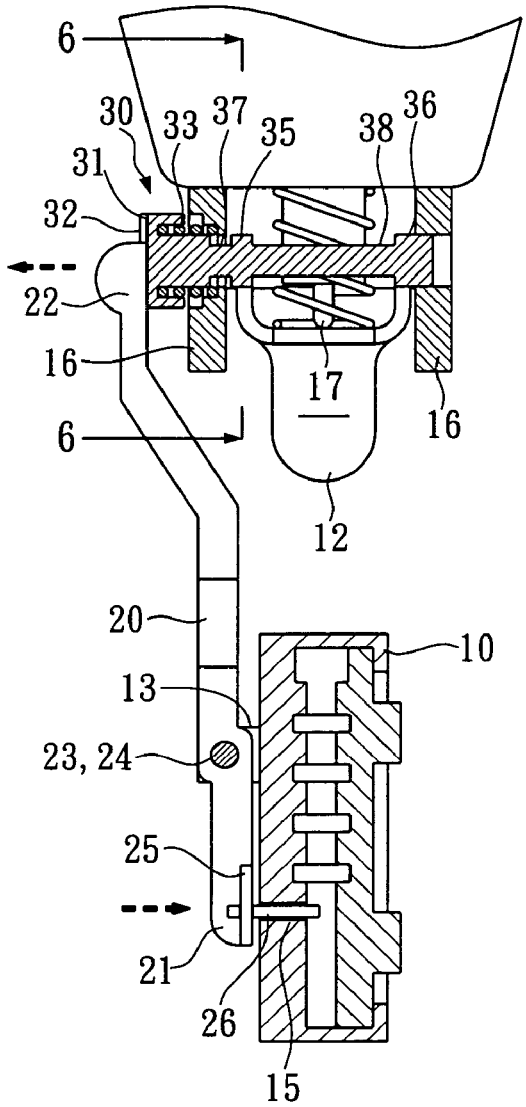
FIG. 4 is according to FIG. 2 and showing no nail in the magazine.
Figure 6:
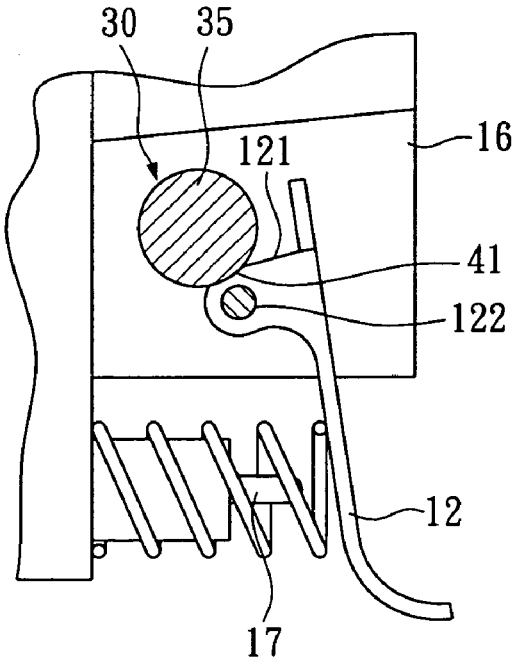
FIG. 6 is a sectional view taken along line 6-6 of FIG. 4.

In FIGS. 4 and 6, when there is no nail 19 loaded in the magazine 10, the force shoring up the tenon 26 outward the magazine 10 ceases. Thusly, there is no force from the lever arm and 22 constrain the head 31 of the cotter 30. The spring 33 of the cotter 30 brings the first and second convex portions 35, 36 to arrest and hold the retaining parts 41, 42 of the trigger 12. Then trigger 12 cannot be cocked.

In summation of the above description, the present invention enhances the performance of the conventional structure, and further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What the invention claimed is:

1. An arresting mechanism for a nail gun, wherein the nail gun comprises a magazine, a nailing mechanism including a trigger mechanism with at least one retaining part; the arresting mechanism arranged to jam the retaining part of the trigger mechanism so as to prevent the trigger from cocking and firing when there are no nails in the magazine; the arresting mechanism comprising:

a cotter having an axial length and defining a convex portion therealong, the cotter arranged for axial sliding movement in the nailing mechanism;

the cotter having a cotter head at one end thereof;

a sensing component arranged outwardly of the magazine and operatively connected therein so as to determine whether or not there is at least one nail in the magazine; the sensing component provided with a lever arm in operative contact with the cotter head and arranged to press thereon to constrain the cotter in a firing mode when there is at least one nail in the magazine, the lever arm arranged to cease pressing on the cotter head allowing the cotter to move to a non-operable mode when there are no nails in the magazine;

a resilient member operatively arranged to move the cotter axially when there are no nails in the magazine from the firing mode to the non-operable mode;

the convex portion of the cotter arranged to be clear of the retaining part of the trigger mechanism to produce the firing mode, but to move the convex portion of the cotter axially into jamming contact with and to arrest the retaining part of the trigger mechanism to produce the non-operable mode.

2. An arresting mechanism for a nail gun, wherein the nail gun comprises a magazine, a nailing mechanism including a trigger mechanism operatively connected between a first pin plate and second pin plate; the trigger mechanism provided with at least one retaining part; the arresting mechanism arranged to jam the retaining part of the trigger mechanism so as to prevent the trigger from cocking and firing when there are no nails in the magazine; the arresting mechanism comprising:

a cotter having an axial length and defining a convex portion therealong, the cotter arranged for axial sliding movement in the nailing mechanism;

the cotter having a cotter head at one end thereof;

a sensing component arranged outwardly of the magazine and operatively connected therein so as to determine whether or not there is at least one nail in the magazine;

the sensing component provided with a lever arm in operative contact with the cotter head and arranged to press thereon constraining the cotter in a firing mode when there is at least one nail in the magazine, the lever arm arranged to cease pressing on the cotter head allowing the cotter to move to a non-operable mode when there are no nails in the magazine;

a resilient member operatively arranged to move the cotter axially when there are no nails in the magazine from the firing mode to the non-operable mode;

the convex portion of the cotter arranged to be clear of the retaining part of the trigger mechanism to produce the firing mode, but to move the convex portion of the cotter axially into jamming contact with and to arrest the retaining part of the trigger mechanism to produce the non-operable mode.

3. The arresting mechanism as claimed in claim 2, wherein the sensing component has a magazine end opposite from the lever arm end, the sensing component journaled for pivot about a pin located in a mounting space outside of and defined by the magazine.

4. The arresting mechanism as claimed in claim 2, wherein:

a pin mounted in the magazine is positioned in a mounting space formed by the magazine;

the sensing component is journaled for rotary movement about the pin;

the sensing component provided with a mounting hole through which the pin passes for sidewise turning of the magazine end about the pin and consequent movement of the lever arm end relative to the cotter head.

5. The arresting mechanism as claimed in claim 2, wherein a tenon is disposed at the magazine end of the sensing component and extends into the magazine via a through hole.

6. The arresting mechanism as claimed in claim 2, wherein a socket is disposed on the nailing mechanism to receive the lever arm end of the sensing component on the head of said cotter.

7. The arresting mechanism as claimed in claim 2, wherein the resilient means is a spring disposed between one of the pin plates and the said of head cotter.

8. The arresting mechanism as claimed in claim 2, wherein two wing sections are mounted at each side of the trigger mechanism to receive a pin piercing there through to moveably fix the trigger between the two pin plates and the retaining part is disposed on a surface of at least on of the wing sections.

9. The arresting mechanism as claimed in claim 2, wherein the retaining part is a socket for receiving the axial convex portion of said cotter.

10. The arresting mechanism as claimed in claim 2, wherein:

in addition to the convex portion along the axis of the cotter there is a second convex portion along the axis of the cotter;

there are also arranged along the axis of the cotter a first concave portion and a second concave portion;

the first concave portion is disposed between said convex portion and said cotter head, the second concave portion is disposed between said convex portion and the second convex portion.

* * * * *